US006439095B1

(12) United States Patent
Sugiyama et al.

(10) Patent No.: US 6,439,095 B1
(45) Date of Patent: Aug. 27, 2002

(54) PAPER CASSETTE PROVIDED WITH A CUTTER

(75) Inventors: Naoshi Sugiyama; Hidemi Sasaki, both of Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/481,517

(22) Filed: Jan. 12, 2000

(30) Foreign Application Priority Data

Jan. 13, 1999 (JP) ..... 11-006848

(51) Int. Cl.[7] ..... B26D 1/01
(52) U.S. Cl. ..... 83/857; 83/902; 83/912
(58) Field of Search ..... 83/856, 857, 858, 83/912, 425, 444, 423, 417, 902

(56) References Cited

U.S. PATENT DOCUMENTS 3,153,853 A * 10/1964 Lipton
3,432,926 A * 3/1969 Kristal
4,786,946 A * 11/1988 Jessop
5,036,739 A * 8/1991 Clar
5,516,221 A * 5/1996 Lake
5,746,103 A * 5/1998 Addison et al.

* cited by examiner

*Primary Examiner*—Kenneth E. Peterson
(74) *Attorney, Agent, or Firm*—Sughrue Mion, PLLC

(57) ABSTRACT

A paper cassette is provided with a first guide groove and a second guide groove. In these guide grooves, first and second cutter blades are respectively arranged. The first cutter blade is separated from a guide face of the first guide groove by a length L1. A recording paper is moved along the first guide groove under a condition that an edge of the recording paper abuts on the guide face. In this way, a right margin of the recording paper having a width L1 is cut off by the first cutter blade. Similarly, a left margin of the recording paper is cut off by the first cutter blade. Top and bottom margins of the recording paper are cut off with the second cutter blade by moving the recording paper along the second guide groove.

4 Claims, 10 Drawing Sheets

PAPER CASSETTE PROVIDED WITH A CUTTER

BACKGROUND OF THE INVENTION

1. Field of the Invention

The present invention relates to a paper cassette used for a printer and provided with a cutter.

2. Description of the Related Art

It is performed in practice that a recording paper or a paper package is contained in a paper cassette with which a printer is loaded for feeding the recording paper into the printer. Meanwhile, by a certain printing method, it is possible to obtain a high-quality image being equal to a silver-salt photograph. As to such printing methods, there are a heat transfer printing method of a sublimate type, a thermal printing method of a directly coloring type, and so forth. In virtue of these methods, a printer used in a home is on the market.

In a thermal printer, printing is not carried out for the whole of the recording paper but is carried out for a recording area except for a margin. This is for the purposes of keeping stable contact between a thermal head and a recording paper, and of stably transferring the heat from the thermal head to the recording paper. On the other hand, it is general that a silver-salt photograph has no margin. Thus, with respect to the silver-salt photograph and the print of the thermal printer, the respective impressions thereof are different from each other due to existence of the margin. When such photographs and prints are stuck in an album together, a strange feeling occurs. In order to remove this feeling, the margin is sometimes cut off by a pair of scissors or a cutter blade.

Therefore, there arises a problem in that it takes a great deal of time to cut off the margin after printing. Further, since the margin is cut off by the scissors or the cutter blade, cutting is likely to be obliquely performed and a cutting line is likely to be curved.

SUMMARY OF THE INVENTION

In view of the foregoing, it is a primary object of the present invention to provide a paper cassette in which a margin of a recording paper can be cut off with accuracy.

It is a second object of the present invention to provide a paper cassette in which a margin of a recording paper can be easily and efficiently cut off.

It is a third object of the present invention to provide a paper cassette in which a margin of a recording paper can be freely set at any width.

In order to achieve the above and other objects, the paper cassette according to the present invention comprises a cutter for cutting off the margin of the recording paper. In a preferred embodiment, the cutter includes a guide groove and a cutter blade.

The guide groove is for guiding an edge of the printed recording paper. The cutter blade is arranged in this guide groove. The recording paper is moved along the guide groove in a state that the edge of the recording paper abuts on a guide face of the guide groove. During the movement of the recording paper, the margin thereof is cut off by the cutter blade arranged in the guide groove.

It is preferable to provide the cutter blades for the top-and-bottom margins and for the right-and-left margins. Moreover, it is preferable that a length from the cutter blade to the guide face is changeable. Further, the cutter blade may be constituted of a roll blade.

In another embodiment, the cutter includes a cutter table and a cutter blade. The cutter table is for placing the printed recording paper thereon. The cutter blade is arranged so as to surround a recording area of the recording paper. The margin of the recording paper is cut off by moving one of the cutter table and the cutter blade toward the other thereof.

BRIEF DESCRIPTION OF THE DRAWINGS

The above objects and advantages of the present invention will become apparent from the following detailed description of the preferred embodiments of the invention when read in conjunction with the accompanying drawings, in which.

DETAILED DESCRIPTION OF THE PREFERRED EMBODIMENT(S)

Figure 1:
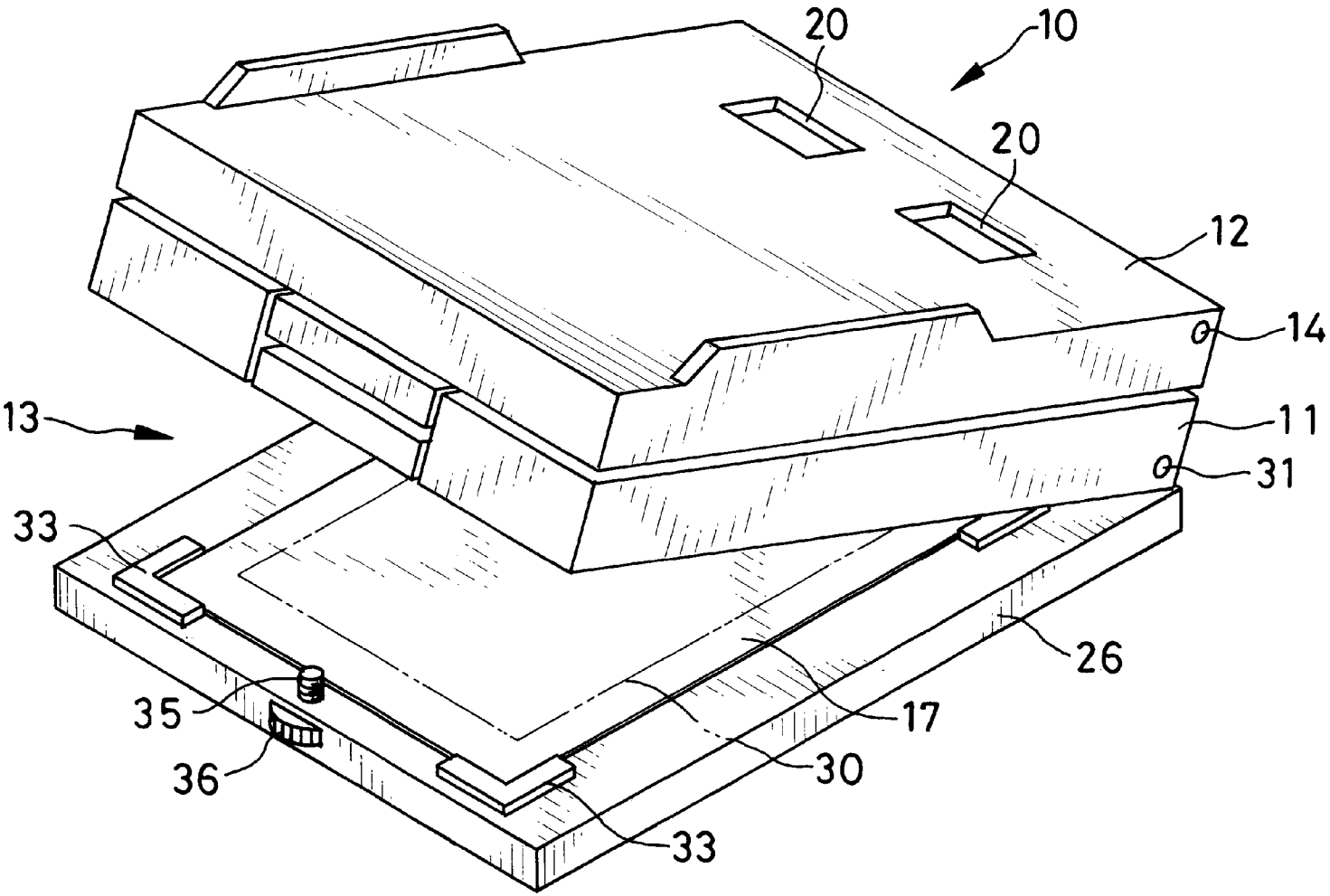
FIG. 1 is a perspective view showing a paper cassette of the present invention in a state that a cutter is opened.
Figure 2:
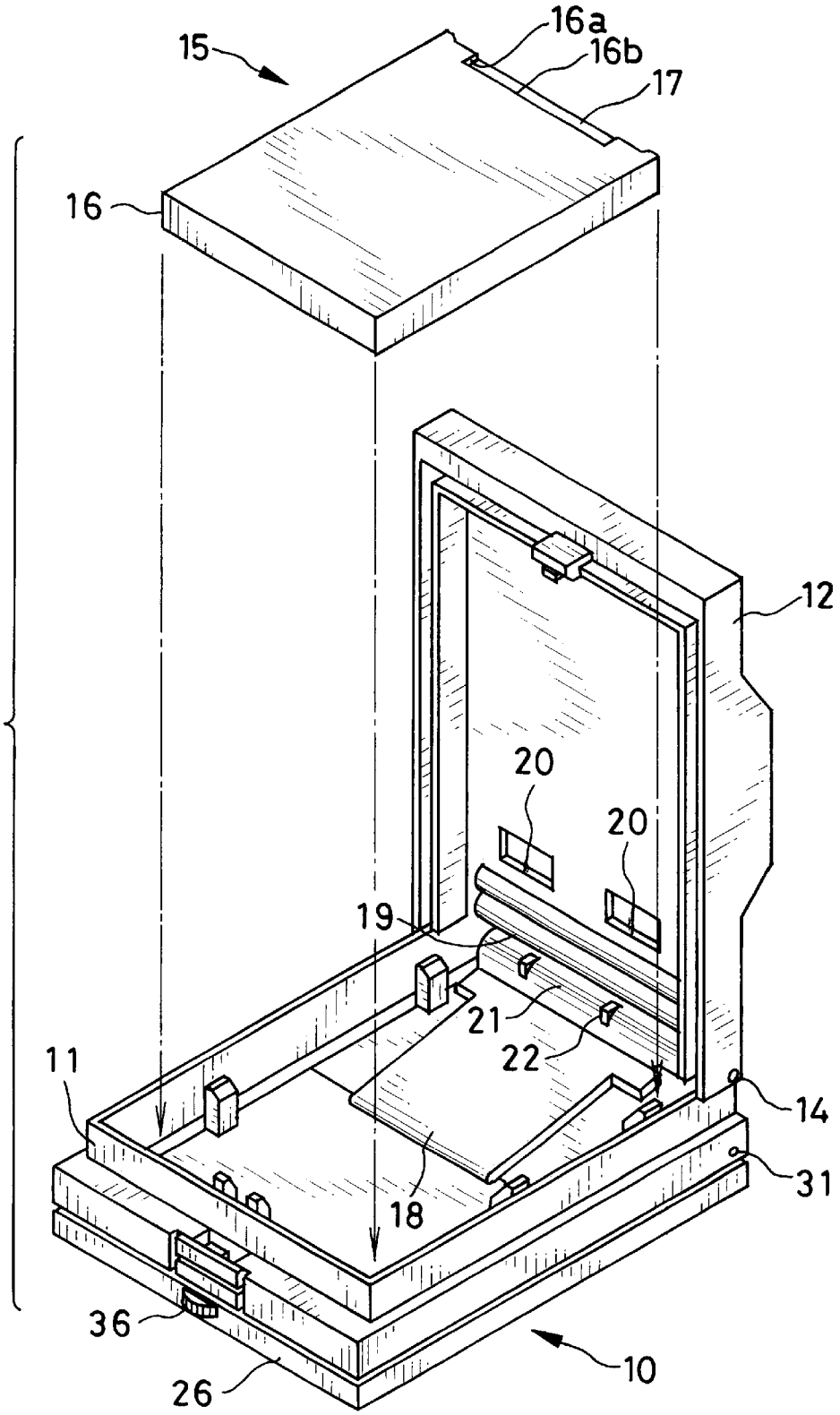
FIG. 2 is a perspective view showing the paper cassette in a state that the paper cassette is loaded with a paper package.

FIGS. 1 and 2 are perspective views showing a paper cassette 10 according to the present invention. The paper cassette 10 is constituted of a cassette body 11, a lid 12 and a cutter 13. The cassette body 11 has a box-like shape, and a lid 12 is openably attached thereto via a mounting shaft 14.

As shown in FIG. 2, the cassette body 11 is loaded with a paper package 15. The paper package 15 comprises a packaging body 16 in which thermosensitive recording papers 17 are stacked. The packaging body 16 has a box-like shape and is made of a cardboard including a long fiber. One end of the packaging body 16 is opened as a paper feed mouth 16*a*. The recording papers 17 are inserted through the paper feed mouth 16*a* in a state that the twenty recording papers 17 are stacked. The recording paper 17 is contained such that a support member thereof is positioned upside and a thermosensitive coloring face thereof is directed downward.

As to a bottom plate of the packaging body 16, a part thereof is adapted to be movable in an up-and-down direction. Via this movable bottom plate, the recording paper 17 is biased upward by a paper biasing plate 18 provided in the paper cassette 11. Moreover, the packaging body 16 is formed with a roller insertion opening 16*b* so as to continue to the paper feed mouth 16*a*. A paper feeding roller (not shown) comes into contact with the recording paper 17 through the roller insertion opening 16*b*. The recording paper 17 is advanced through a paper outlet 19 upon rotation of the paper feeding roller. The paper feeding roller is arranged in a printer and comes into contact with the recording paper 17 through a roller opening 20 of the paper cassette 10.

A paper separating section 21 is provided in the paper cassette 11 adjacent to the paper outlet 19. When the plural recording papers 17 are simultaneously advanced, the paper separating section 21 permits to forward only the uppermost recording paper 17. The other recording paper 17 is retained by a paper separating claw 22.

Figure 3:
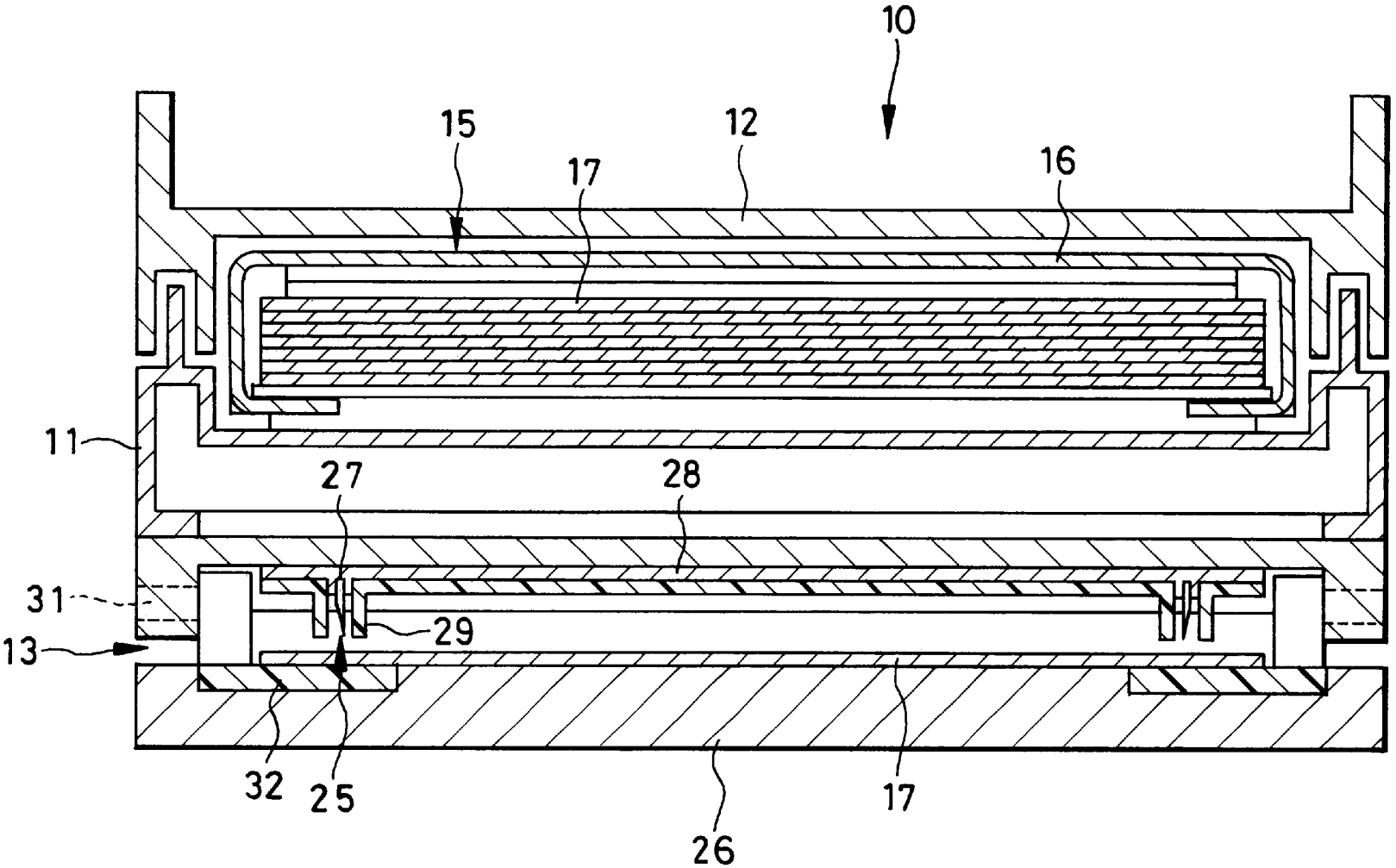
FIG. 3 is a partial section view of the paper cassette.

As shown in FIG. 3, the cutter 13 is disposed on the bottom of the cassette body 11 and is constituted of a cutter blade 25 and a cutter table 26. The cutter blade 25 is attached to the bottom of the cassette body 11 and is constituted of a main blade 27, a blade holder 28 and a paper pressing member 29.

The main blade 27 is fixed to the blade holder 28 so as to form a rectangle-shaped cut line 30 (see FIG. 1). By means of the main blade 27, four margins 17*a*, 17*b*, 17*c* and 17*d* of the recording paper 17 are cut off. The paper pressing member 29 is made of a plastic sponge and is arranged at both sides of the main blade 27 so as to catch it.

The cutter table 26 is openably attached to the cassette body 11 via a mounting shaft 31. An upper surface of the cutter table 26 is provided with a cushioning material 32 positioned opposite to the main blade 27. The cushioning material 32 is made of a plastic sponge and receives the tip of the main blade 27 after cutting the recording paper 17. Moreover, as shown in FIG. 1, the upper surface of the cutter table 26 is provided with L-shaped guide members 33 arranged opposite to four corners of the recording paper 17. The guide member 33 sets the recording paper 17 at a cutting position. The cutter table 26 is urged in an opening direction by a coiled spring which is not shown.

As shown in FIG. 1, a setscrew 35 and a dial 36 for rotating the setscrew 35 are arranged at the center of the front edge of the cutter table 26. The top of the setscrew 35 meshes with a nut (not shown) provided at the bottom of the cassette body 11. The nut is mounted so as to be slidable in an axis direction of the setscrew 35 and so as not to rotate. The nut is urged downward by a coiled spring. Upon rotation of the dial 36 after closing the cutter table 26, the setscrew 35 meshes with the nut so that the cutter table 26 is kept at a closing position. Incidentally, when the cutter 13 is used, the dial 36 is rotated in reverse to release the engagement of the setscrew 35 and the nut. Due to this, the cutter table 26 is opened by urging force of the coiled spring.

Next, an operation of the above-mentioned embodiment is described. After printing, the paper cassette 10 is removed from a cassette port of the printer. Successively, the dial 36 is rotated to release the engagement of the setscrew 35 and the nut. After the cutter table 26 has been opened, the recording paper 17 is placed on the opened cutter table 26. At this time, the recording paper 17 is positioned at the cutting position in virtue of the guide members 33. Then, the cassette body 11 is pressed downward so that the cutter blade 25 comes into the recording paper 17. In other words, one of the cutter table 26 and the cutter blade 25 is moved toward the other thereof so that the edge of the recording area is cut to cut off the margin portion of the recording paper 17. The recording area of the recording paper 17 having been cut is separated from the cutter blade 25 owing to urging force caused by deformation of the paper pressing member 29.

Figure 4:
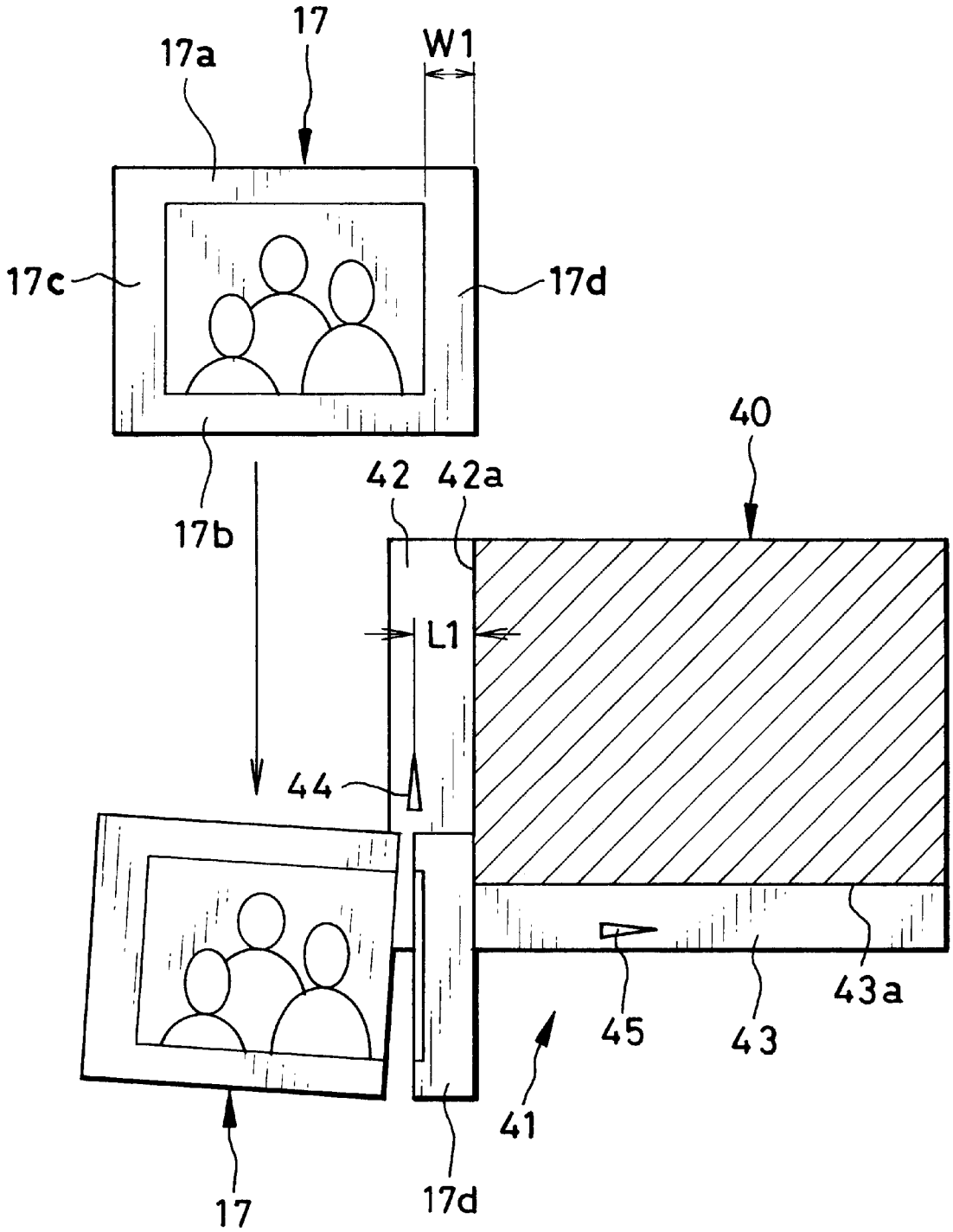
FIG. 4 is an explanatory illustration showing a cutoff of a right-side margin.
Figure 5:
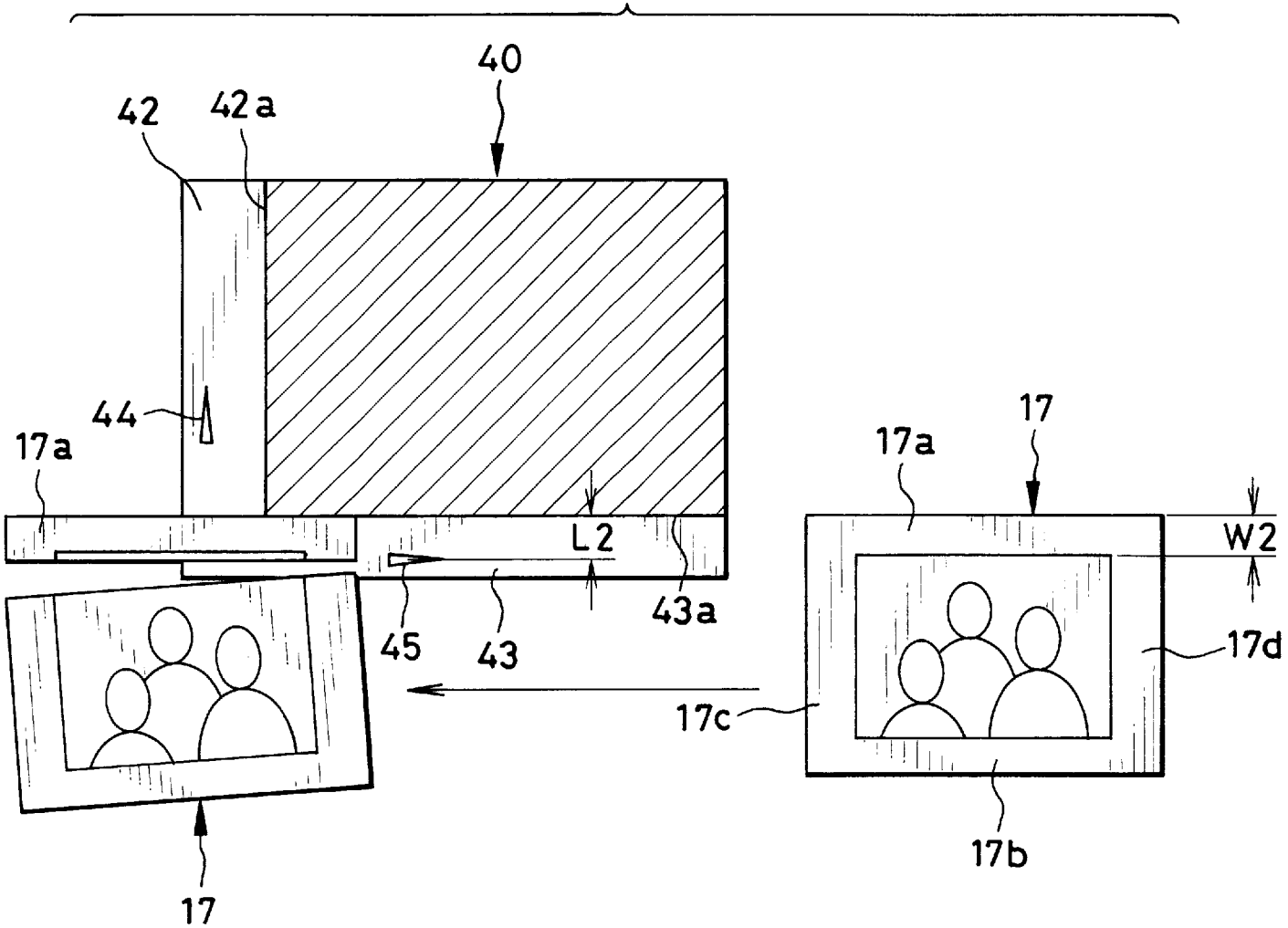
FIG. 5 is an explanatory illustration showing a cutoff of a top-side margin.
Figure 6:
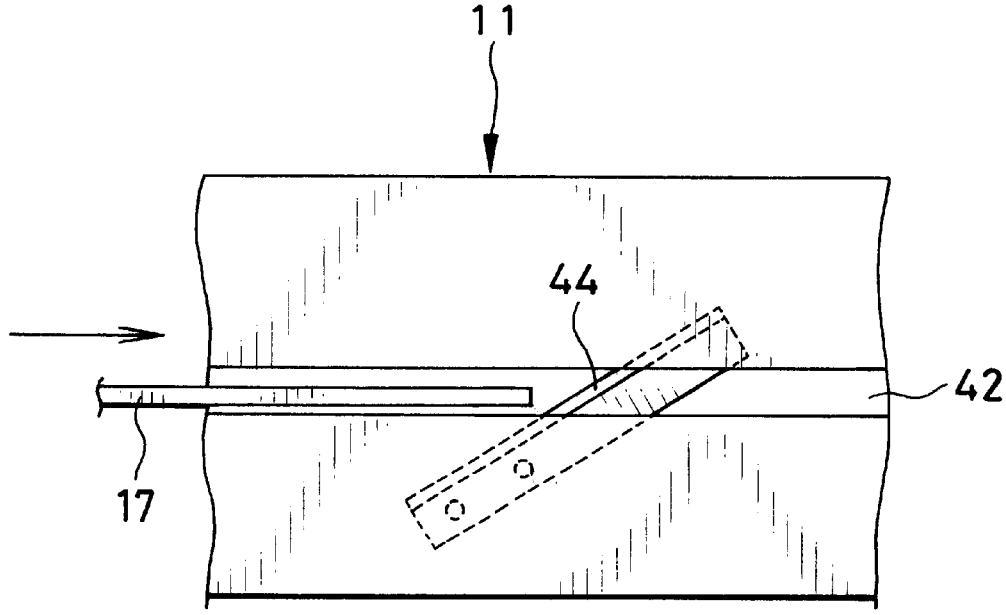
FIG. 6 is a side view showing a cutter blade disposed in a guide groove.

FIGS. 4 through 6 show a cutter 41 of a paper cassette 40 according to another embodiment. The cutter 41 comprises guide grooves 42, 43 and cutter blades 44, 45. The guide groove 42 and the cutter blade 44 are for cutting the right-and-left margins. The guide groove 43 and the cutter blade 45 are for cutting the top-and-bottom margins. The guide groove 42 is formed at an edge portion of the paper cassette 40 opposite to a paper feed mouth thereof. The guide groove 43 is formed at an edge portion of the paper cassette 40 being parallel to a paper feeding direction. The guide grooves 42 and 43 are formed on the same level so that ends of these grooves are connected.

As shown in FIG. 6, the cutter blade 44 is slantingly arranged in the guide groove 42 so that resistance at a commencement of cutting is adapted to be reduced. The other cutter 45 is slantingly arranged as well. An angle of inclination may be suitably changed in accordance with thickness and quality of the recording paper. Otherwise, the cutter blades 44 and 45 may be arranged at right angles relative to a moving direction of the recording paper 17.

As shown in FIGS. 4 and 5, the cutter blades 44 and 45 are respectively arranged so as to be separated from guide faces 42*a* and 43*a* of the guide grooves 42 and 43 by lengths L1 and L2. The respective lengths L1 and L2 are slightly longer than widths W1 and W2 of the margins. The recording paper 17 is inserted into each of the guide grooves 42 and 43. At this time, the recording paper 17 is moved along the guide faces 42*a* and 42*b*. Owing to this action, the margins 17*a* through 17*d* of the recording paper 17 are cut off by the cutter blades 44 and 45. The guide grooves 42 and 43 are arranged at edge portions of the paper cassette 40 and at positions corresponding to the location of the margins so that the correspondence between the margins and the guide grooves is made clear. Thus, the recording paper 17 may be prevented from being inserted into the wrong guide groove.

Figure 7:
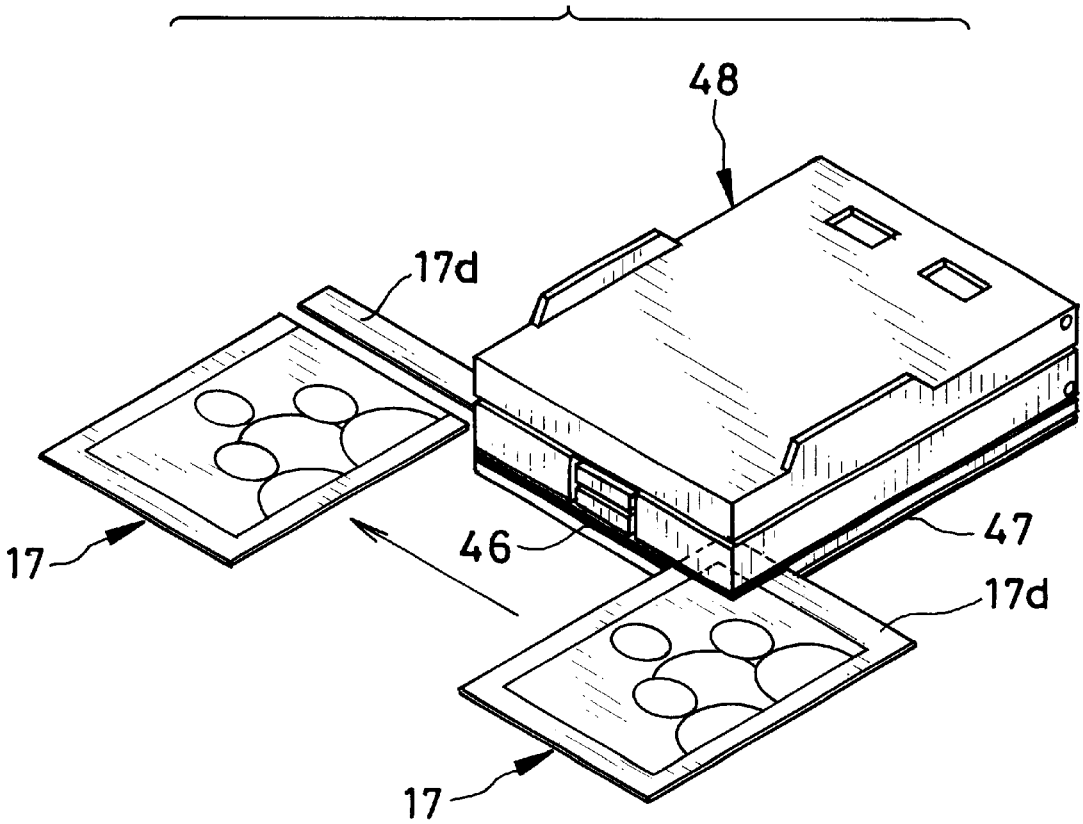
FIG. 7 is a perspective view showing a cutoff of a right-side margin regarding a paper cassette in which guide grooves are formed in parallel.
Figure 8:
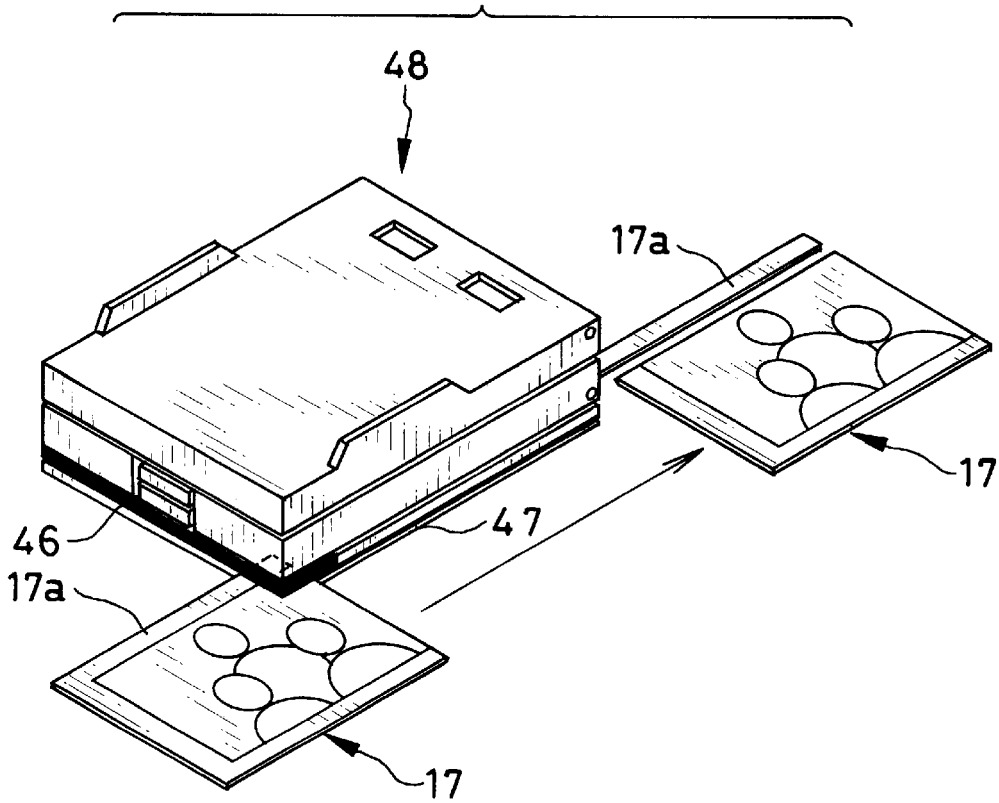
FIG. 8 is a perspective view showing a cutoff of a top-side margin regarding the paper cassette shown in FIG. 7.

By the way, the guide grooves are on the same level in the above embodiment. Otherwise, as shown in FIGS. 7 and 8, a paper cassette 48 may be provided with uneven guide grooves 46 and 47, each of which is arranged at a different level.

Figure 9:
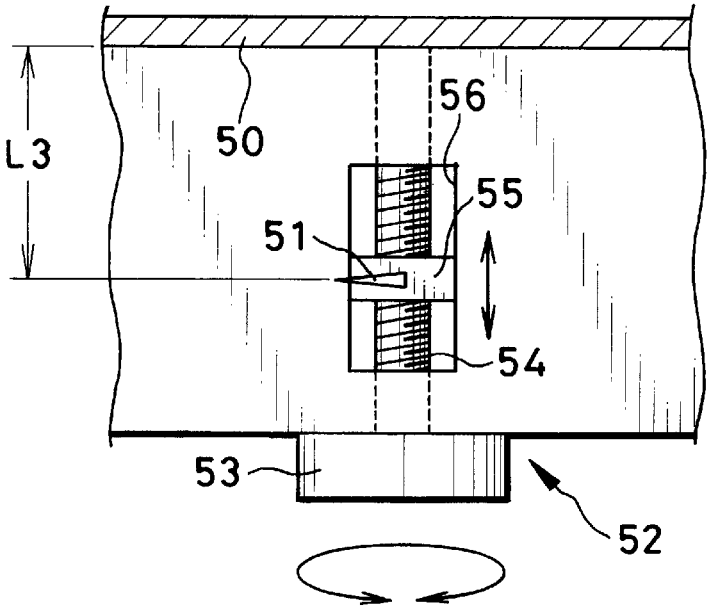
FIG. 9 is a partial plan view showing another embodiment in which a distance between a guide face and a cutter blade is variable.

Further, as shown in FIG. 9, a distance L3 between a guide face 50 and a cutter blade 51 may be changed by means of a translation operation mechanism including a feed screw 52 and so forth. In this case, a dial 53 is rotated to revolve a screw rod 54 so that the cutter blade 51 fixed to a female screw 55 is moved in a crosswise direction. The female screw 55 is held by a guide opening 56 so as not to be rotated and so as to be movable in an axis direction of the screw rod 54. In virtue of this mechanism, a width of the cut margin may be freely determined.

Figure 10:
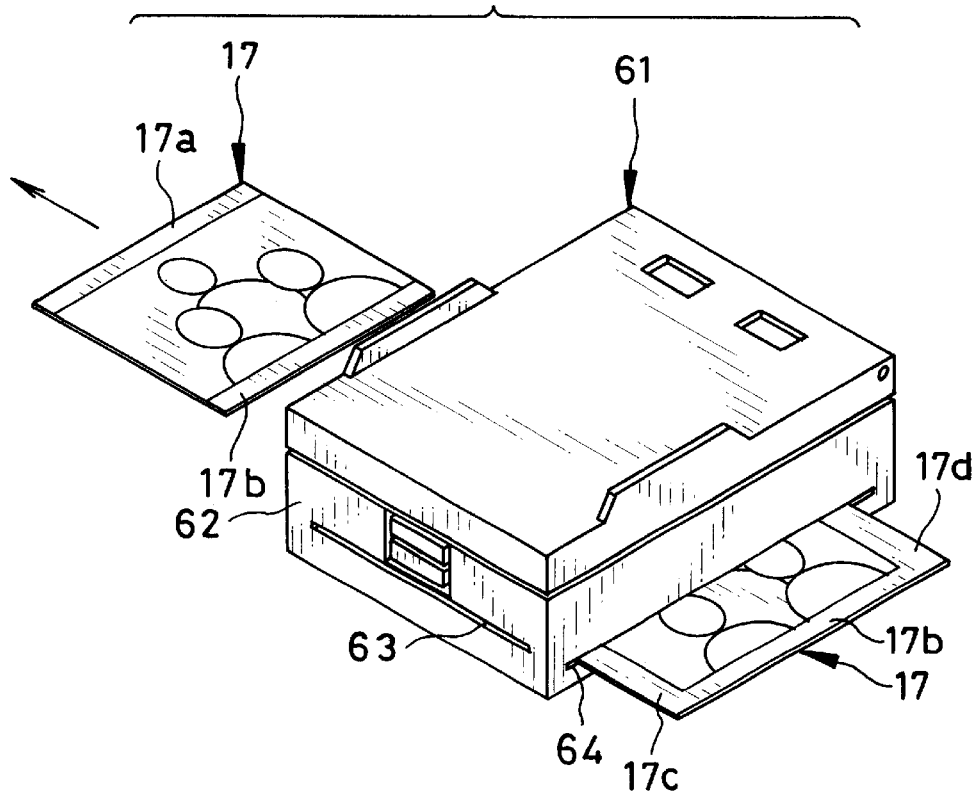
FIG. 10 is a perspective view showing a cutoff of right-and-left margins regarding a paper cassette in which a roll blade is used.
Figure 11:
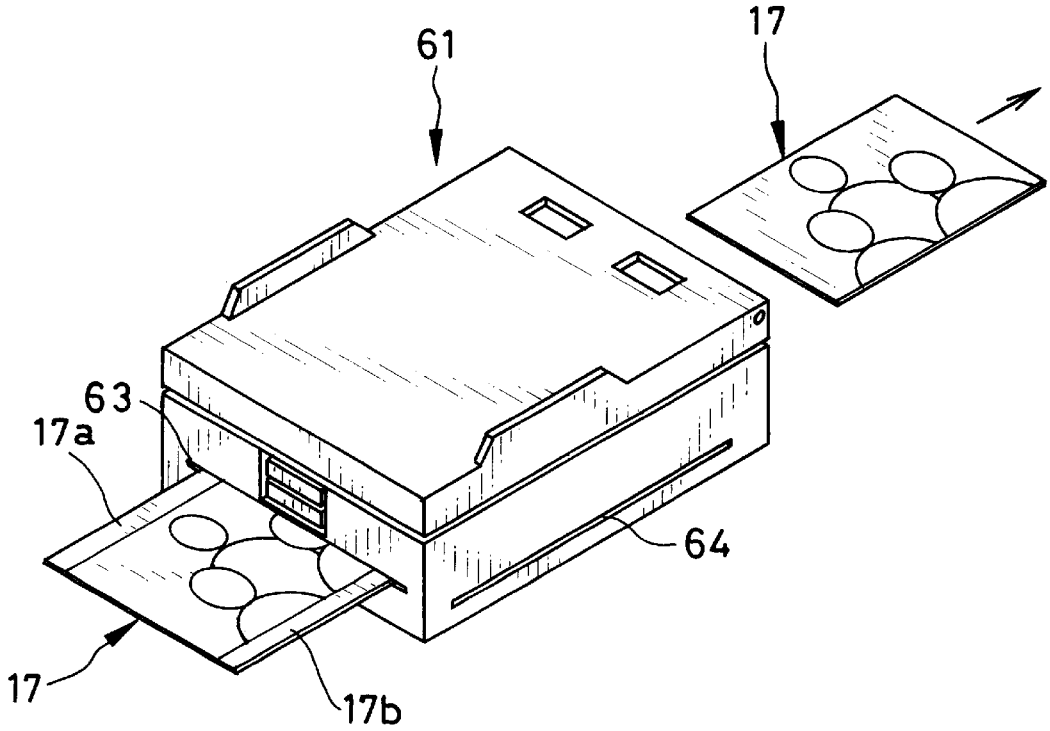
FIG. 11 is a perspective view showing a cutoff of top-and-bottom margins regarding the paper cassette shown in FIG. 10.

FIGS. 10 through 13 show a paper cassette 61 according to the other embodiment in which a roll blade is employed. As shown in FIGS. 10 and 11, a cassette body 62 of the paper cassette 61 is provided with uneven slits 63 and 64 formed at a lower portion of the cassette body 62. The slit 63 is for cutting the top-and-bottom margins, and the slit 64 is for cutting the right-and-left margins. These slits construct guide grooves for cutting the recording paper.

Figure 12:
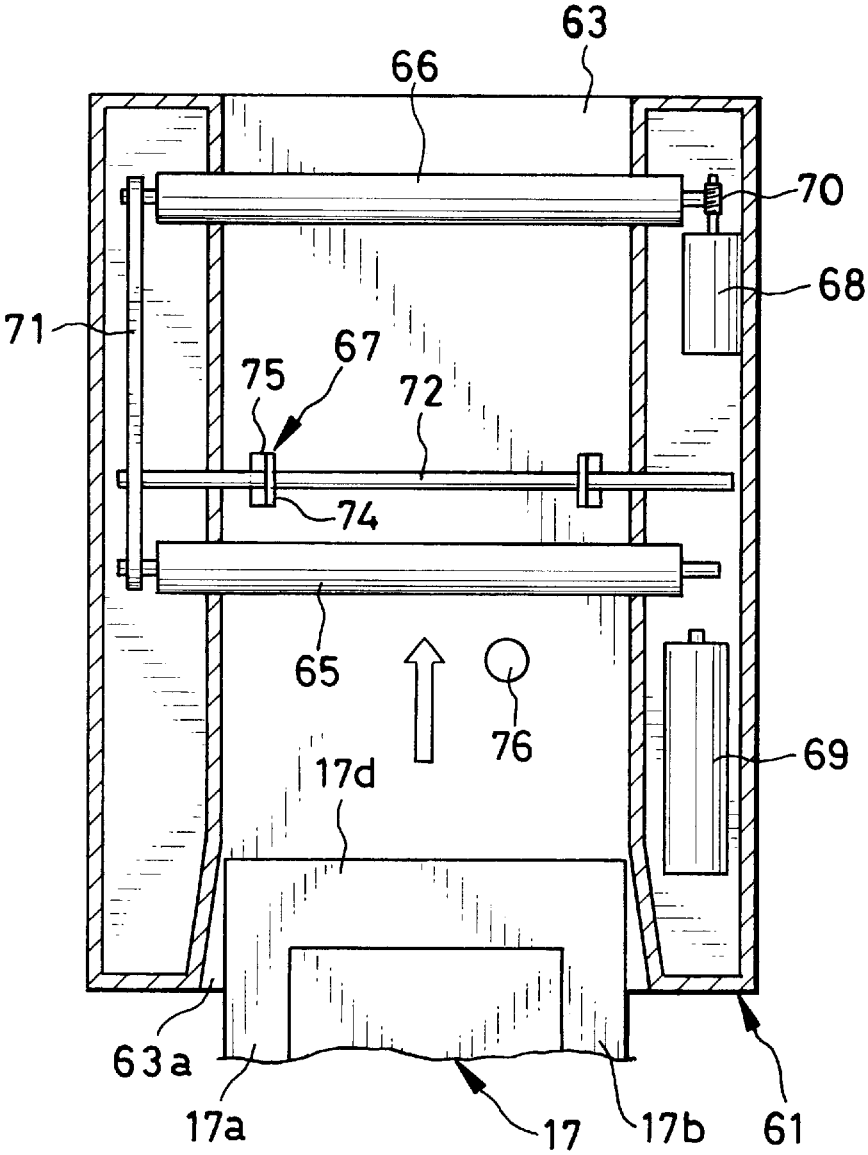
FIG. 12 is a schematic illustration showing structure of a section for cutting the top-and-bottom margins.

As shown in FIG. 12, in the slit 63 for cutting the top-and-bottom margins, are disposed conveyor roller pairs 65 and 66, and a pair of roll blades 67. Meanwhile, a motor 68 and a battery 69 for driving this motor 68 are attached to the inside of the cassette body 62. The motor 68 rotates the conveyor roller pair 66 via a worm gear 70. The conveyor roller pairs 65 and 66 are associated with the pair of the roll blades 67.

Figure 13:
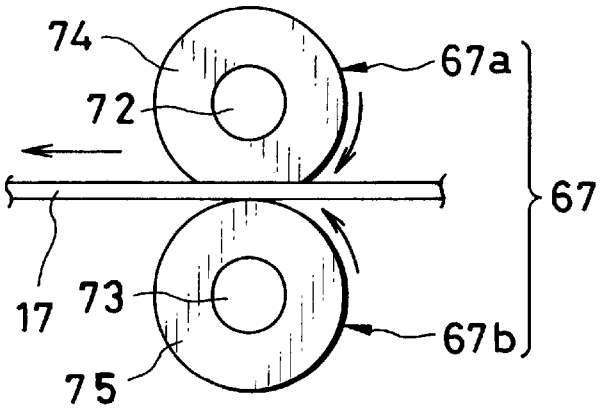
FIG. 13 is a side view showing the roll blade.

As shown in FIG. 13, the roll blade 67 is constituted of an upper blade 67*a* and a lower blade 67*b*. The upper blade 67*a* comprises a disk-shaped cutter 74 attached to a mounting shaft 72, and the lower blade 67*b* comprises a receiving roller 75 attached to a mounting shaft 73. The recording paper 17 passes through a place between the upper blade 67*a* and the lower blade 67*b* so that the top-and-bottom margins 17*a* and 17*b* of the recording paper 17 are cut off. Incidentally, the lower blade 67*b* is constituted of the receiving roller 75. However, instead of this, the lower blade 67*b* may be similar to the upper blade 67*a*.

In the slit 63, a paper sensor 76 are disposed between a paper inlet 63*a* and the conveyor roller pair 65. The paper sensor 76 detects the recording paper 17 having been inserted into the slit 63. A controller which is not shown drives the motor 68 on the basis of a paper detection signal. The motor 68 is driven until the recording paper 17 is discharged. In this way, the top-and-bottom margins 17*a* and 17*b* of the recording paper 17 are cut off.

The slit 64 for cutting the right-and-left margins are similarly constructed. When the recording paper 17 is inserted into the slit 64, the motor 68 is driven for predetermined duration to cut off the right-and-left margins 17*c* and 17*d* of the recording paper 17. The battery 69 may be omitted in this embodiment. In such case, the power is obtained from the printer via a connector or the like. In case the margins are adapted to be cut off without removing the paper cassette from the printer, it is preferable to construct the guide groove and the slit so as to convey the recording paper in a direction being perpendicular to the paper feeding direction.

Figure 14:
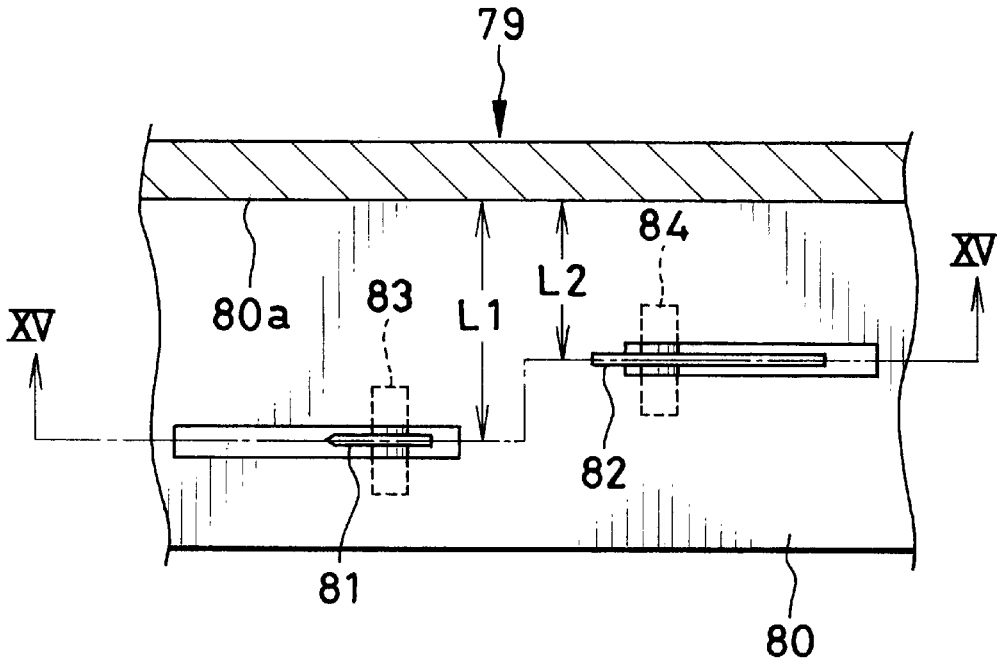
FIG. 14 is a plan view showing a guide groove of the other embodiment in which two cutter blades are arranged.
Figure 15:
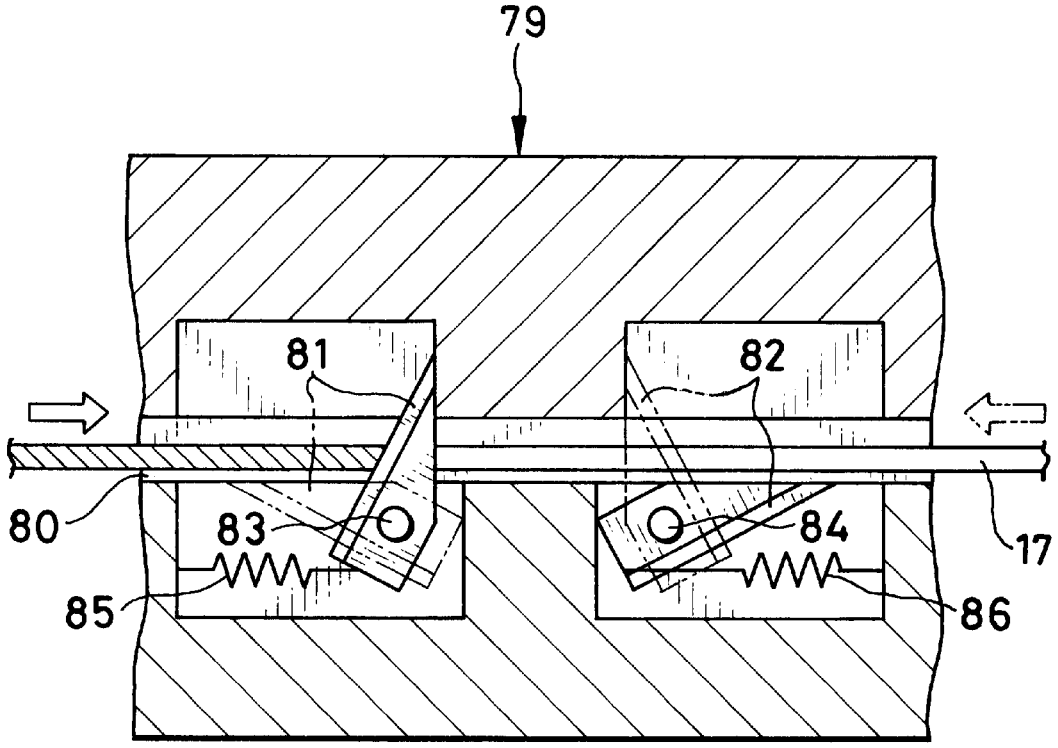
FIG. 15 is a sectional view taken along the line XV—XV of FIG. 14 and showing movements of the cutter blades.

In the above-described embodiments, the guide grooves 42, 43, 46, 47 or the slits 63, 64 are formed for cutting the four margins. Otherwise, the respective margins may be cut off by using a single guide groove or a single slit. In this case, as shown in FIG. 14, two cutter blades 81 and 82 are provided in a guide groove 80 of a cassette body 79 so as to be respectively separated from a guide face 80*a* by different lengths L1 and L2. Further, as shown in FIG. 15, the cutter blades 81 and 82 are set such as to be directed in reverse directions. At the same time, the cutter blades 81 and 82 are adapted to be movable between a cutting position and an evacuation position by means of mounting shafts 83 and 84. Further, the cutter blades 81 and 82 are respectively urged toward the cutting positions thereof by coiled springs 85 and 86. Thus, when the recording paper 17 does not exist in the guide groove 80, the cutter blades 81 and 82 are stood up and are set at the cutting positions.

Under a condition in that the cutter blade 81 disposed at the left side in FIG. 15 is set at the cutting position, when the recording paper 17 is inserted in the paper cutting direction, the cutter blade 81 is kept at the cutting position without moving. Thus, the margin of the recording paper 17 having a width L1 is cut off. On the other hand, the right-side cutter blade 82 is rotated by the front edge of the recording paper 17 to be set at the evacuation position. Therefore, the recording paper 17 is not cut by the cutter blade 82.

When the recording paper 17 is inserted in a reverse direction relative to the above-mentioned direction, the cutter blade 82 disposed at the right side is moved from the evacuation position shown by a solid line to the cutting position shown by a two-dotted line, for example. Thus, the margin of the recording paper having a width L2 is cut off. Meanwhile, the left-side cutter 81 is set at the evacuation position since the back thereof is pushed by the edge of the recording paper 17. After the recording paper 17 has passed, the cutter blades 81 and 82 are automatically returned from the evacuation position to the cutting position.

In the above embodiments, the cutter blade and the roll blade are arranged at the lower portion of the cassette body 11. However, these may be arranged at a side-central portion of the cassette body or an upper portion thereof. Further, the cutter blade and so forth may be arranged on a lid.

Instead of arranging the fixed blade or the swingable blade in the guide groove, the roll blade such as shown in FIG. 13 may be arranged in the guide groove. In case two roll blades are arranged in a single guide groove such that their distances from the guide face are different, for example, one of the cutters for the top-and-bottom margins is set at a cutting position and the other cutter is set at an evacuation position when the recording paper is inserted along one direction. And then, when the recording paper is inserted along the other direction, the cutter for the right-and-left margins is set at the cutting position and the other cutter is set at the evacuation position. Setting the respective cutters at the cutting position and the evacuation position is performed by using a link mechanism or a selection mechanism constituted of a solenoid, a motor an so forth.

In the above embodiment shown in FIG. 1, the main blade is constructed so as to form the rectangular cut line. However, besides this, the main blade may be constructed so as to be an oval, a heart shape, a circle and so forth. In this case, it becomes possible to cut the recording area in various forms. Moreover, in order to selectively use the blades, the cutter blade and the cutter table may be removably attached to the cassette body.

In the above embodiment, the present invention is applied to the paper cassette used for the thermal printer. However, the present invention is applicable to paper cassettes used for a heat transfer printer, an ink-jet printer, and various printers of other systems.

According to the present invention, the paper cassette is provided with the cutter for cutting the margin of the recording paper so that the margin of the recording paper can be easily cut off without preparing a cutter or the like separately. In virtue of this, it is possible to easily obtain a print being similar to a general photo print and having no margin.

The present invention includes the cutter table on which the printed recording paper is placed, and the cutter blade for surrounding the recording area of the recording paper. The recording paper is cut by moving one of the cutter table and the cutter blade so that the margin of the recording paper can be easily cut off. Further, the recording paper is cut along the predetermined cut line so that the recording paper is prevented from being cut in a crooked state.

The present invention includes the guide groove for guiding the edge of the printed recording paper, and the cutter blade arranged in the guide groove. The recording paper is moved along the guide groove to be cut by the cutter blade. The margin can be cut off along the edge of the recording paper so that the cut line is prevented from being curved. Similarly, by using the roll blade, the cut line is prevented from being curved.

The cutter blades or the roll blades are provided for the top-and-bottom margins and the right-and-left margins respectively so that only the margins may be efficiently cut off. Further, by changing the distance between the cutter blade and the guide wall, it is possible to freely determine the width of the margin being cut. The cutting resistance may be reduced by using the roll blade so that the margin may be easily cut off.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A paper cassette removably attachable to a printer, comprising:

a cassette body for containing recording papers in a stack state;

a cutter for cutting off, for each recording paper having been printed by said printer, a periphery of said recording paper; and a printer from which the paper cassette is removable;

wherein said printer records an image in a recording area outside a first margin of said periphery, and said cutter cuts off said first margin;

wherein said cutter includes a first guide groove for guiding an edge of said recording paper, and a first cutter blade arranged in said first guide groove, said first margin being cut off with said first cutter blade by moving said recording paper along said first guide groove;

wherein said first cutter blade is a plate-shaped blade;

wherein said printer records the image in a recording area outside a second margin of said periphery, said cutter cuts off said second margin, said cutter includes a second guide groove for guiding another edge of said recording paper, and at least a second cutter blade arranged in said second guide groove, said second margin being cut off with said second cutter blade by moving said recording paper along said second guide groove; and wherein said first and second guide grooves are formed at each of a longitudinal side and a lateral side of said paper cassette, respectively, and said first and second cutter blades are arranged in said first and second guide grooves, respectively, one of said cutter first and a second blades cutting off top-and-bottom margins and the other of said first and second cutter blades cutting off right-and-left margins.

2. A paper cassette according to claim 1, wherein said first and second cutter blades are slantingly arranged in said respective first and second guide grooves.

3. A paper cassette according to claim 1, wherein said first and second guide grooves are formed on a same level.

4. A paper cassette according to claim 1, wherein said first and second guide grooves are formed on different levels.

* * * * *